United States Patent [19]

Cuffia

[11] Patent Number: 4,759,550

[45] Date of Patent: Jul. 26, 1988

[54] BAT WITH ELASTICALLY CONNECTED BALL

[76] Inventor: Allen W. Cuffia, 4917 Poe Ave., Baltimore, Md. 21215

[21] Appl. No.: 46,102

[22] Filed: May 5, 1987

[51] Int. Cl.[4] ..... A63B 67/10

[52] U.S. Cl. ..... 273/330

[58] Field of Search ..... 273/330, 58 C

[56] References Cited

U.S. PATENT DOCUMENTS

| | | | |
|---|---|---|---|
| 1,282,016 | 10/1918 | McHenry | 273/330 |
| 2,009,698 | 7/1935 | Marx | 273/330 |
| 2,269,633 | 1/1942 | Merle | 273/330 |
| 2,622,880 | 12/1952 | Walsh | 273/330 |
| 2,848,236 | 8/1958 | Gibson, Jr. | 273/58 C |
| 3,229,979 | 1/1966 | Smoak, Jr. | 273/330 |
| 3,382,609 | 5/1968 | Neanhouse | 273/58 C |
| 4,145,051 | 3/1979 | Krumholz | 273/330 |
| 4,272,076 | 6/1981 | Song et al. | 273/58 C |

FOREIGN PATENT DOCUMENTS

| | | | |
|---|---|---|---|
| 414017 | 7/1934 | United Kingdom | 273/330 |

*Primary Examiner*—William H. Grieb

[57] ABSTRACT

A system of the type having a ball connected to a bat by an elastic strip, has in one version a bat formed of polystyrene foam with a plug frictionally held in a hole through the bat face from front to back around which any surplus elastic-strip is wound to provide an adjustable length of elastic strip. The plug has a flat end and a contoured end, either of which can be axially adjusted when installed at the front face of the bat to vary the contour against which the ball impacts when batted. Relative silence in batting the ball results from the use of plastic foam material and from handle-free contour, making it necessary to grip around edges and back of bat with spread fingers, this local support tending to muffle vibration and sound. This gripping of the edges of the bat also provides training in muscular action like that needed in dribbling basketball.

7 Claims, 1 Drawing Sheet

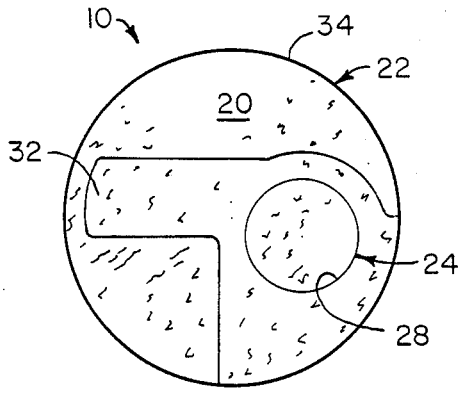
FIG. 1
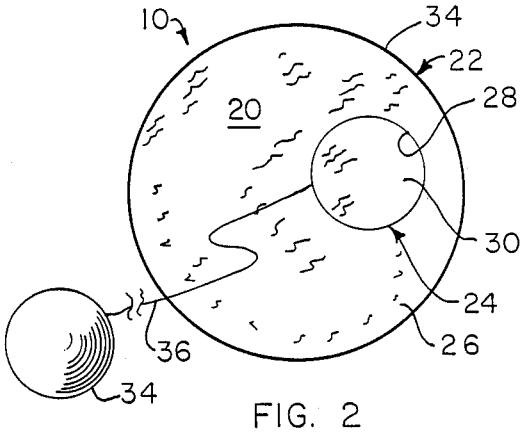
FIG. 2
FIG. 3
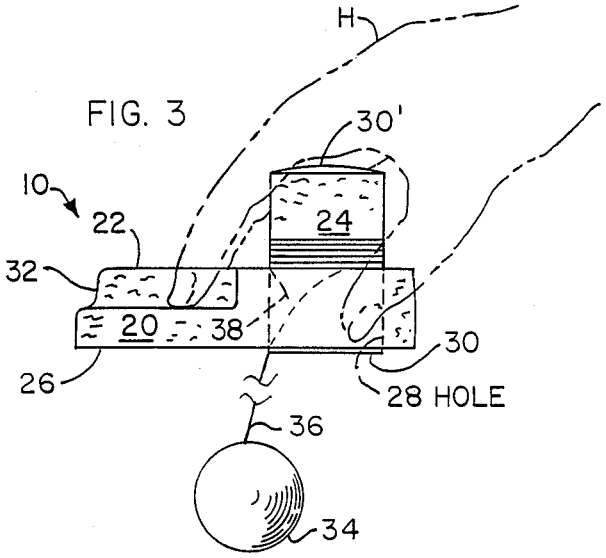
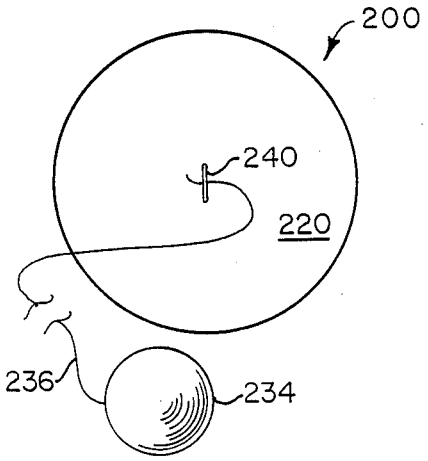
FIG. 4
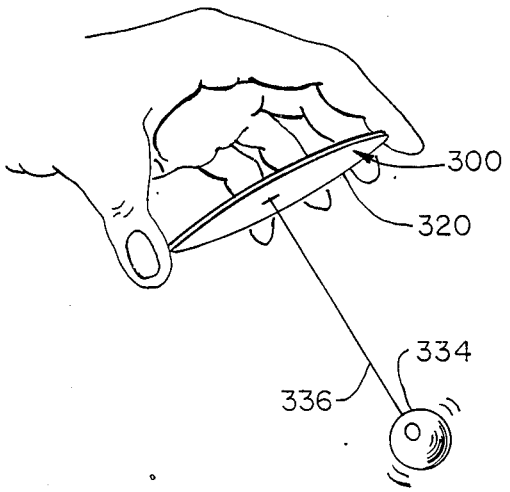
FIG. 5

BAT WITH ELASTICALLY CONNECTED BALL

FIELD OF THE INVENTION

This invention relates generally to game and sports systems and particularly to improved equipment of the paddleball type.

BACKGROUND OF THE INVENTION

Paddle-ball systems as a type include usually a rubber ball tethered to a paddle by an elastic member such as a strip. The ball is batted away by the paddle, returned by the elastic strip and batted again, successively as many times as the skill and endurance of the user permit or until the user's interest flags.

In the known art are the following U.S. patents:

U.S. Pat. No. 2,622,880 granted to T. F. Walsh on 12-23-52 showed a means for winding the elastic for storage but did not suggest adjustably shortening the elastic length use;

U.S. Pat. No. 4,272,076 granted to J. M. Song and S. B. Ligon on 6-9-81, showed a ball tethered by a line to a small square base that could evidently be held in the hand as a paddle, if desired;

U.S. Pat. No. 3,382,609 granted to N. C. Neanhouse on 5-14-68, showed a ball tethered through a hole in a middle part of a face of a base to a member inside the base around which it is rolled by an electric motor. This evidently could be used as paddle ball apparatus with adjustable line-length, particularly if elastic were used in place of the cord;

U.S. Pat. No. 3,229,979 granted to S. E. Smoak, Jr. on 1-19-66, showed provision of a circular paddle instead of a paddle with handle; evidently the circular shape could be held directly by the user's hand;

U.S. Pat. No. 2,848,236 granted to J. E. Gibson, Jr. on 8-19-58, showed the provision of a handle equipped square paddle.

The ordinary type system described can give the user valuable hand-eye coordination training, exercise and amusement, at a very low cost. It would be logical to think that almost every child would have and frequently use one or more of the paddle-ball systems but such is not the case. In the ordinary case, a child will learn to bat the ball a few times without missing and will then put it aside for other, more stimulating diversions.

The problem may be that once learned, the operation of the ordinary system offers not enough further variety or challenge to the user to maintain interest. To some extent, also, there is for users indoors particularly, an element of danger from the swinging paddle, ordinarily hard and often splintery material such as wood, and also an element of noise. When the ball is hit hard it can make conversation difficult indoors.

SUMMARY OF THE INVENTION

Objects of the invention are to provide a system as described that, in embodiments: will improve hand-eye coordination and teach the principal motion of basketball dribbing without tiring the wrist but instead building up the muscles used in basketball dribbling; that promotes blood circulation, that can be changed and adjusted to offer more fun through different degrees of challenge, that is quieter in operation and is safer to use than other systems, that is economical to make, ship and sell, and that is durable, attractive in appearance, light in weight and pleasant to the touch.

BRIEF DESCRIPTION OF THE DRAWINGS

The above and other objects and advantages of this invention will become more readily apparent on examination of the following description, including the drawings in which like reference numerals refer to like parts.

FIG. 1 is a top plan view of a first, preferred, embodiment of the invention;

FIG. 2 is a bottom plan view thereof;

FIG. 3 is an elevational view of the first embodiment in use, with a portion broken away for convenience in exposition;

FIG. 4 is a perspective view of a second embodiment; and

FIG. 5 is a perspective view of a third embodiment, in use.

DETAILED DESCRIPTION

FIGS. 1–3 show preferred embodiment 10, that has a massive strong and light bat 20 made, according to this invention, of two pieces 22, 24 of polystyrene foam of the type used as thermal insulating panels.

The first piece 22 or base has preferably a flat bottom 26 and a cylindrical hole 28 passing through it transverse to the flat bottom.

The second piece 24 or plug may also have a flat bottom 30 or end and fits securely but adjustably in the hole 28. The two flat bottoms 26, 30 may be adjusted to be co-planar if desired, for easy play.

The base 22 preferably has at the front, or portion oriented away from the user, an integral rib 32 that can be grasped by the hand H of a user between the ends of the user's forefinger and middle finger, as shown. The user's thumb and other fingers may grasp the circular or cylindrical perimeter of the base, and the user's palm may rest on the upper end 30' of the plug 24. Raised portions of the base adjoining the rib help the grip and help stabilize the plug and hold it in the hole 28 at the axial adjustment selected.

A ball 34, preferably of sponge rubber depends from the bat 20 by means of an elastic strip 36 (shown broken to indicate length not shown) or line, at a first end threaded into or otherwise secured to the ball 34 in any suitable conventional manner, and at the second end 38 passed from the bottom into the hole 28 and adjustably held in the hole between the plug 24 and the base 22 with the surplus wound around the plug adjacent to 38.

The length of elastic strip may be quickly changed to suit the user's mood by pulling out and turning the plug in one hand and unreeling more or less elastic strip, as desired, while holding the base in the other hand. Further, the hole 28 being preferably off-center relative to the base 20, the elastic strip 36 can be adjusted to vary the challenge by changing the location at which it emerges from the pinch between plug and base, causing it to retract the ball to a different location on the bat by the elastic action when batted. The plug 24 provides a further adjustment that varies the challenge or difficulty of the game of repetitive batting of the ball: the bottom surface 30 of the plug may be set to protrude, one degree of such setting shown, so that for a true bounce from the plug area the ball must strike squarely on the bottom surface 30 of the plug. Even though the diameter of the hole preferably is big enough to pass a ball of the diameter 1 3/16 in. (2.9 cm) usually used, the end of the plug still presents a fairly small target.

As another challenge, the plug may by adjustment be recessed in the lower surface 26 of the bat so that the user must, in playing, swing the bat so as to cause the opposite effect, in which the ball may fit into the hole 28 or else miss the hole altogether, to preserve a true bounce from the bat, at the hole.

As still another challenge, at least one end of the plug 24 may be other than flat, a convex upper end 30' is shown, so that the plug 24 may be reversed in the hole and present a different-shape target for the user to impinge the ball against, with again a different challenge.

With all these embodiments and adjustments the play is relatively silent because of the massive polystyrene foam material and the close support of the bat 20 by the user's hand. A user can bat the ball late at night in a building with less than perfect sound insulation, for example, without disturbing others in the manner of conventional equipment. Diameter of the base 22 may be 4 1/16 in. (10 cm) with thickness of 1 in. (2.5 cm) overall and ⅜ in. (1 cm) at the thinner portions. The hole and plug diameter may be 1⅛ in. (3 cm), the hole center offset may be 1 in. (2.5 cm) and the other dimensions in the proportions indicated.

FIG. 4 shows in second embodiment 200 a circular bat 220 with ball 234 secured to the center by a staple 240 holding an end of a length of elastic strip 236. Because of the shape and size of the bat force the user's hand to grasp the bat around the edges with the bat centered on the palm at the user's hand, this muffles sound of the sharp impacts of the ball on the bat and make it quieter to use, even if the bat is made of solid plastic or wood.

Further, wraparound of the user's fingers over the edges of the bat can vary the area available for batting, changing the challenge. The bat may be 4 1/16 in. (10 cm) in diameter, and 1/16 in. (1.5 mm) thick.

FIG. 5 shows in embodiment 300 a bat 320 of flat material elliptical in outline in a system with ball 334 and elastic strip 336 secured at the center of the ellipse. This system provides in addition to the advantages of the previously described embodiment 200, to which is otherwise similar, variation in the handling and operation of the system by rotation of the bat 320 in the hand to shift the relation of ball and batting surface. The bat is gripped at the first joint of each finger. Major axis of the ellipse may be 4 in. (10 cm) and minor axis of the ellipse may be 4 in. (10 cm) and minor axis 2.5 in. (7 cm).

In summary, it will be appreciated that the invention provides a new approach to enjoyment of systems of the type, without complexity but with versatility.

This invention is not to be construed as limited to the particular forms disclosed herein, since these are to be regarded as illustrative rather than restrictive. It is, therefore, to be understood that the invention may be practiced within the scope of the claims otherwise than as specifically described.

What is claimed and desired to be protected by United States Patent is:

1. In a system of the type having a bat, a ball, an elastic member, means for connecting the bat and ball with the elastic member to provide for operation of the system by repetitive batting of the ball and elastic rebound against the bat, the improvement comprising: the means for connecting including means for adjustably connecting the bat and the elastic member to vary the length of the elastic member and further including means for silencing said operation, the means for silencing including the bat being of plastic foam material, the bat including a base with a flat bottom and having structure defining a hole therein from front to back, and a plug in said hole.

2. In a system as recited in claim 1, the plug and the hole forming a friction fit therebetween, and comprising the means for adjustably connecting the bat and the elastic member by holding a portion of the elastic member between the plug and the structure defining the hole.

3. In a system as recited in claim 2, means for varying playing characteristics of the bat comprising the location of said holding of a portion of the elastic member being variable by rotating the plug.

4. In a system as recited in claim 1, means for varying the contour of the bat to provide differing contact with the ball comprising the plug having a flat lower end and being axially adjustable in the hole so that the plug may protrude from the flat bottom or be co-planar with the flat bottom or be recessed in the flat bottom.

5. In a system as recited in claim 4, the means for varying the contour including the plug having a contoured upper end and being reversible in the hole for varying the contour of the flat bottom.

6. In a system as recited in claim 1, a rib upstanding on the bat in position for grasping between the first two fingers of a user for better gripping the bat.

7. In a system as recited in claim 1, the means for silencing further including the plug being of plastic foam material.

* * * * *